US007594474B2

(12) United States Patent
Zupancich

(10) Patent No.: US 7,594,474 B2
(45) Date of Patent: Sep. 29, 2009

(54) OPEN-TOP RAIL CAR COVERS AND OPEN-TOP RAIL CARS EMPLOYING THE SAME

(75) Inventor: Ronald J. Zupancich, Clayton, NC (US)

(73) Assignee: Martin Marietta Materials, Inc., Raleigh, NC (US)

( * ) Notice: Subject to any disclaimer, the term of this patent is extended or adjusted under 35 U.S.C. 154(b) by 140 days.

(21) Appl. No.: 11/724,494

(22) Filed: Mar. 15, 2007

(65) Prior Publication Data

US 2007/0214997 A1 Sep. 20, 2007

(51) Int. Cl.
*B61D 39/00* (2006.01)
*B61D 3/00* (2006.01)

(52) U.S. Cl. ..... 105/377.01; 105/355; 105/377.11

(58) Field of Classification Search ..... 105/355, 105/377.01, 377.05, 377.07, 377.09, 377.11; 296/100.02, 100.04, 100.05, 100.06, 100.07, 296/100.16, 100.17, 100.18
See application file for complete search history.

(56) References Cited

U.S. PATENT DOCUMENTS 1,888,653 A * 11/1932 Bonsall ..... 52/53
2,742,866 A * 4/1956 Nystrom ..... 105/409
2,985,118 A * 5/1961 Maharich et al. ..... 105/377.01
3,504,637 A * 4/1970 Miller ..... 105/377.01
3,587,476 A * 6/1971 Ingram ..... 105/377.01
3,690,272 A * 9/1972 Ogle et al. ..... 410/77
4,046,082 A * 9/1977 Tedesco et al. ..... 105/377.01
4,275,662 A * 6/1981 Adler et al. ..... 105/377.01
4,368,674 A * 1/1983 Wiens et al. ..... 105/377.01
6,250,233 B1 * 6/2001 Luckring ..... 105/377.01
7,210,413 B2 * 5/2007 Barry et al. ..... 105/404
7,261,044 B2 * 8/2007 Creighton et al. ..... 105/404
2007/0020060 A1 * 1/2007 Hart et al. ..... 410/26
2007/0034110 A1 * 2/2007 Zupancich et al. ..... 105/355
2007/0214997 A1 * 9/2007 Zupancich ..... 105/355

* cited by examiner

*Primary Examiner*—S. Joseph Morano
*Assistant Examiner*—Jason C Smith
(74) *Attorney, Agent, or Firm*—Bachman & LaPointe, P.C.

(57) ABSTRACT

An open-top rail car cover is defined by a frame having dimensions sufficient to fit an open-top freight car designed in accordance with the Association of American Railroads, a roof and a pair of end walls. A latch disposed about a side of the frame includes a first flange and a second flange that combine to define a means for receiving an engagement member of a rail car. Both the first and second flanges include a at least one first aperture and at least one second aperture designed to receive a means for securing the car cover to the rail car. The first and second apertures have dimensions sufficient to permit movement of the first and second flanges about the means for receiving.

22 Claims, 10 Drawing Sheets

OPEN-TOP RAIL CAR COVERS AND OPEN-TOP RAIL CARS EMPLOYING THE SAME

FIELD OF USE

This disclosure relates to open-top rail cars and, more particularly, to open-top rail car covers and open-top rail cars employing the same.

BACKGROUND OF THE INVENTION

Open-top rail cars, such as gondola cars, hoppers and grain cars are employed to transport waste, coal, grain and similar materials that may tend to blow out of the car. A cover is commonly mounted on the open top to contain the car's contents. These open-top covers are constructed to permit various lifting devices to either remove or mount the cover on a stationary car. Such open-top covers are also equipped with a latch mechanism such as the one shown in FIG. 1. Once mounted, the latch mechanism is engaged by lowering the clamp and securing it underneath the top edge of the railway car as shown in FIG. 2. Although such latch mechanisms secure the open-top cover in place, the latches are not flexible and do not permit the cover to move while the rail car is in transit. The cover meanwhile experiences stress and strain at the point of contact between the latch and the rail car during transit. More often than not, the cover breaks in response to such stress and strain as shown in FIG. 3.

Consequently, there exists a need for an open-top rail cover designed to accommodate stress and strain experienced during transit.

SUMMARY OF THE INVENTION

In accordance with one aspect of the present disclosure, an open-top rail car cover broadly comprises a frame having dimensions sufficient to fit a Class G, Class H or Class L freight car in accordance with the Association of American Railroads; a first material disposed in contact with the frame to form a roof; a second material disposed in contact with the frame to form a pair of end walls disposed opposite each other and attached to the roof; and a latch disposed about a side of the frame comprising a first flange and a second flange that combine to define a means for receiving an engagement member of a rail car, wherein the first flange includes at least one first apertures designed to receive a means for securing, the second flange includes at least one second aperture designed to receive the means for securing, the engagement member includes at least one third aperture designed to receive the means for securing, wherein the at least one first aperture, the at least one second aperture and the at least one third aperture are substantially aligned with each other.

In accordance with another aspect of the present disclosure, an open-top rail car with cover broadly comprises an open-top freight car designed in accordance with the Association of American Railroads; wherein the open-top freight car further comprises an engagement member having at least one third aperture designed to receive a means for securing, the engagement member is capable of engaging a car cover disposed about a top portion of said car, wherein the car cover comprises: a frame; a first material disposed in contact with the frame to form a roof; a second material disposed in contact with the frame to form a pair of end walls disposed opposite each other and attached to the roof; and a latch disposed about a side of said frame comprising a first flange and a second flange that combine to define a means for receiving the engagement member, wherein the first flange includes at least one first aperture designed to receive a means for securing, the second flange includes at least one second aperture designed to receive the means for securing, wherein the at least one first aperture, the at least one second aperture and the at least one third aperture are substantially aligned with each other.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The open-top rail car cover and open-top rail car with said cover described herein have a tongue and groove latch mechanism which permits the open-top cover to move an amount sufficient to compensate for the forces acting upon the cover as the rail car moves. During transit, the cover is less likely to buckle under and break in response to such forces. As a result, the open-top cover described herein possesses a longer useful service life which translates into reduced transportation costs over a long term period.

Figure 1:
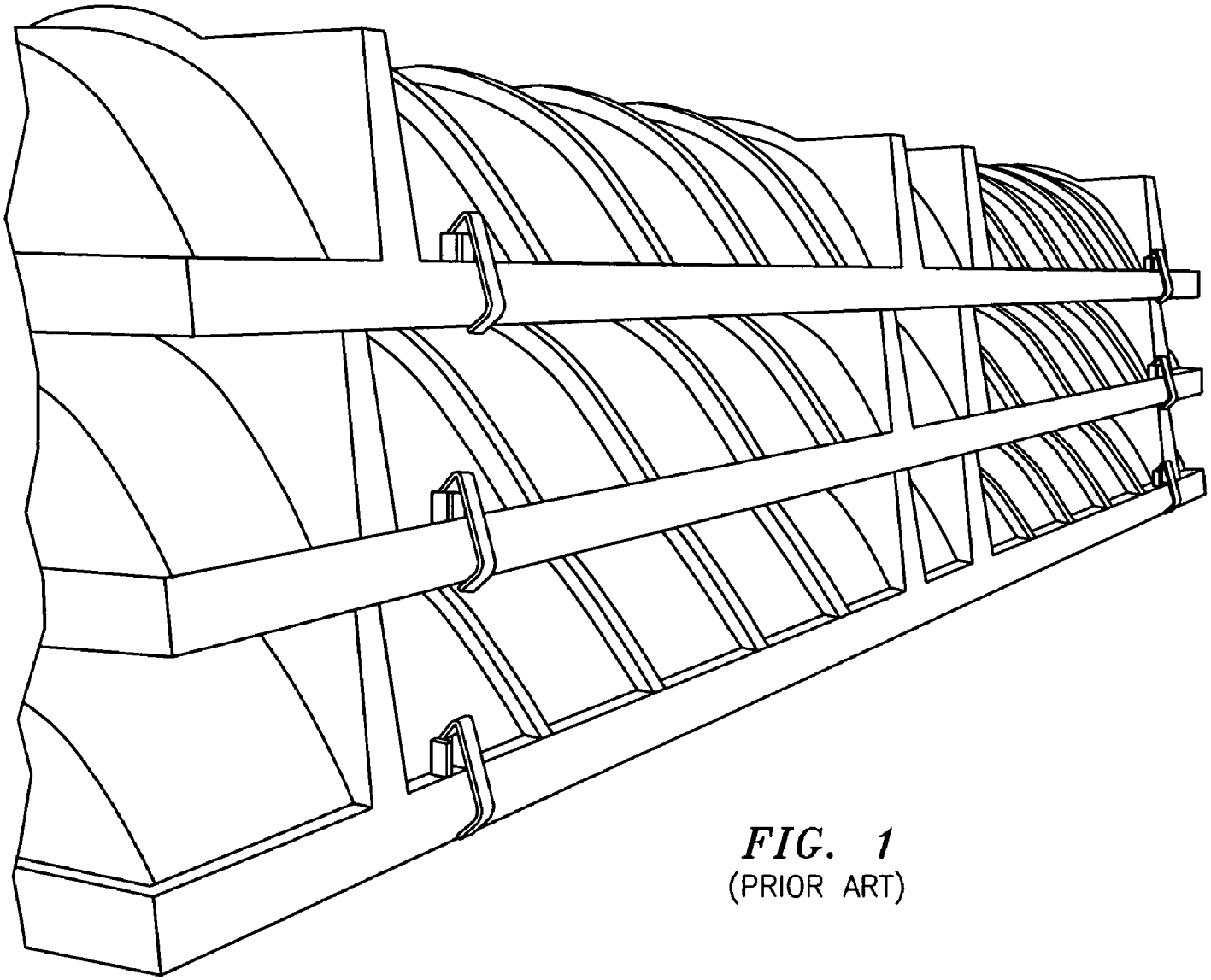
FIG. 1 (PRIOR ART)
FIG. 1 is a representation of an open-top rail car cover of the prior art.
Figure 2:
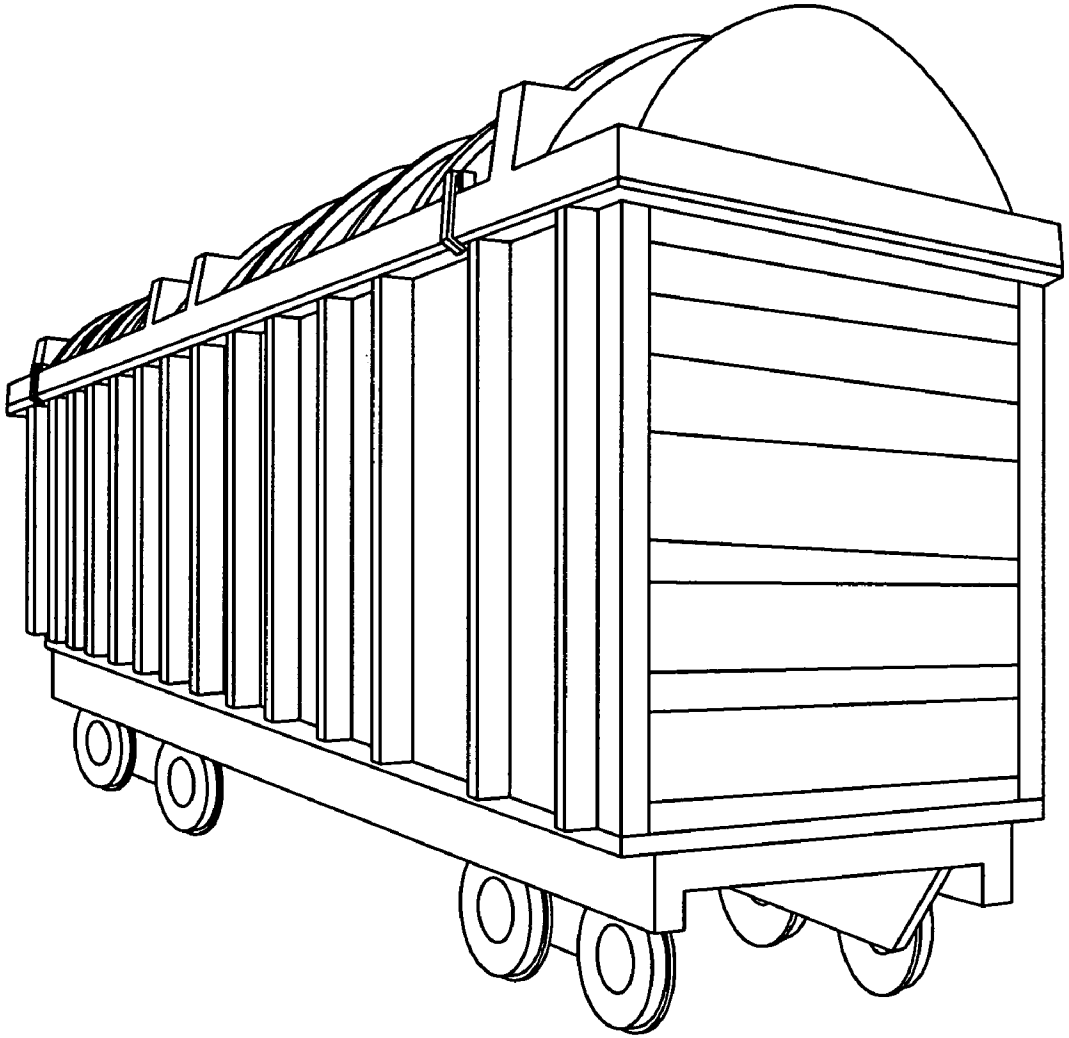
FIG. 2 (PRIOR ART)
FIG. 2 is a representation of the prior art open-top rail car cover of FIG. 1 mounted to an open-top rail car.
Figure 3:
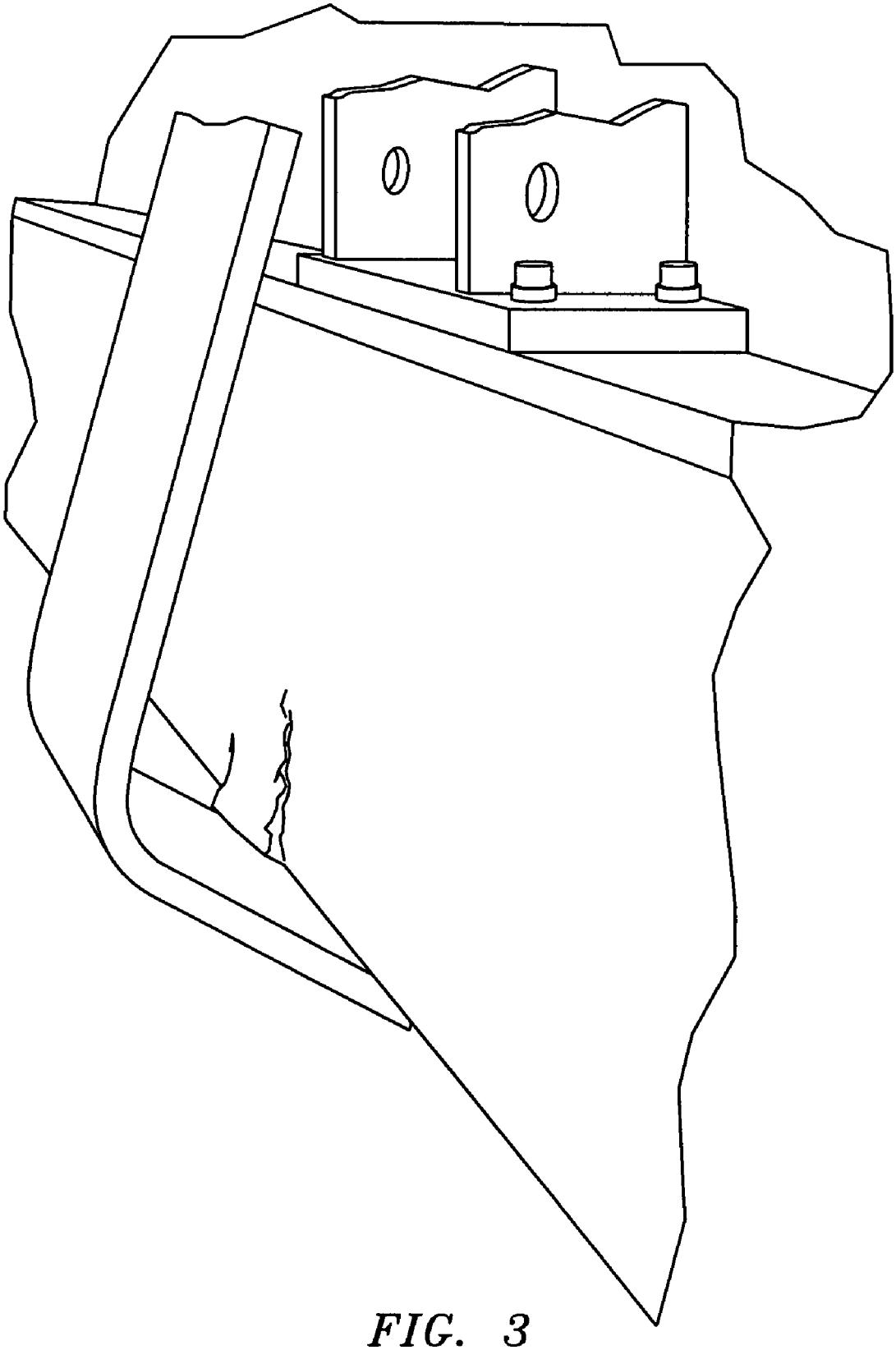
FIG. 3 (PRIOR ART)
FIG. 3 is a representation illustrating the damage experienced by the prior art open-top rail car cover of FIG. 1.
Figure 4:
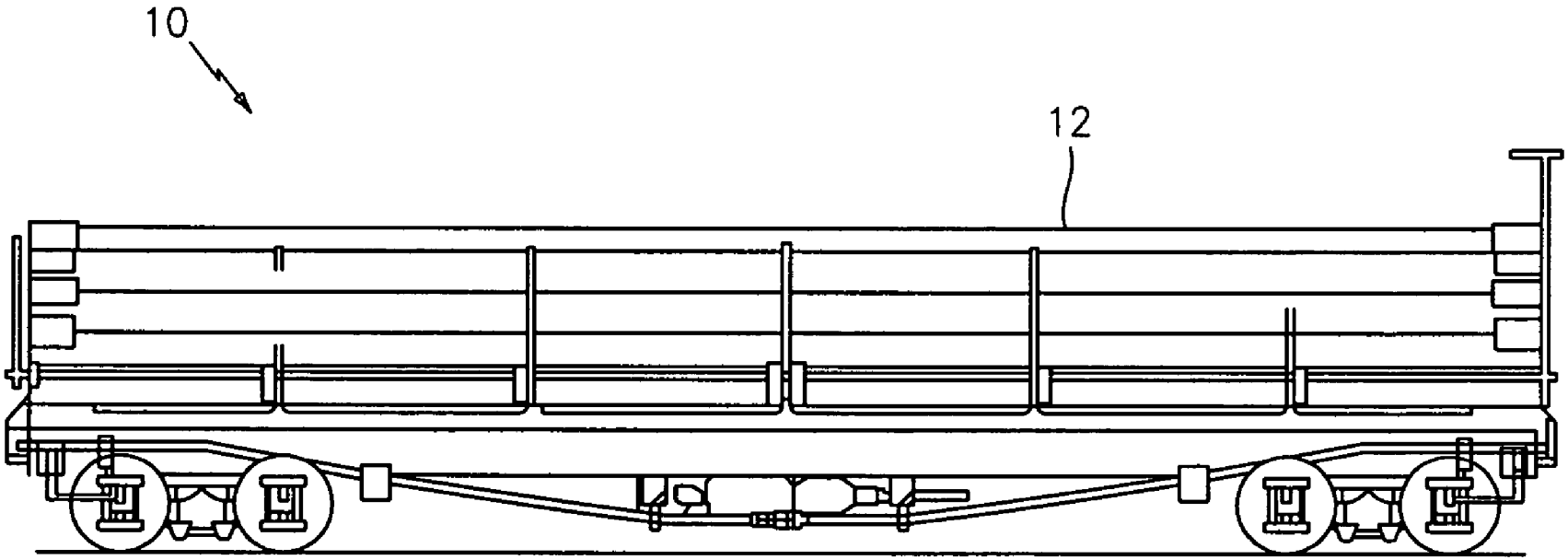
FIG. 4 is a representation of an open-top rail car.

Referring now to FIG. 4, an open-top rail car 10 for use with an open-top rail cover 20 described herein is shown. Open-top rail car 10 may be any open-top rail car or freight car known to one of ordinary skill in the art. Such rail and freight cars are modified and equipped with the aforementioned latch mechanism of the present disclosure. More specifically, the open-top rail car 10 is a freight car that complies with the open-top freight car classifications of the Association of American Railroads (hereinafter "AAR"). The open-top freight car classifications may include, but are not limited to, Class G, Class H, Class L and the like, in accordance with the AAR. The open-top rail car 10 may be modified and equipped with an engagement member 60 which will be described in greater detail. The open-top rail car 10, and engagement member 60 as well, may comprise any material suitable for use in constructing rail cars.

Figure 5:
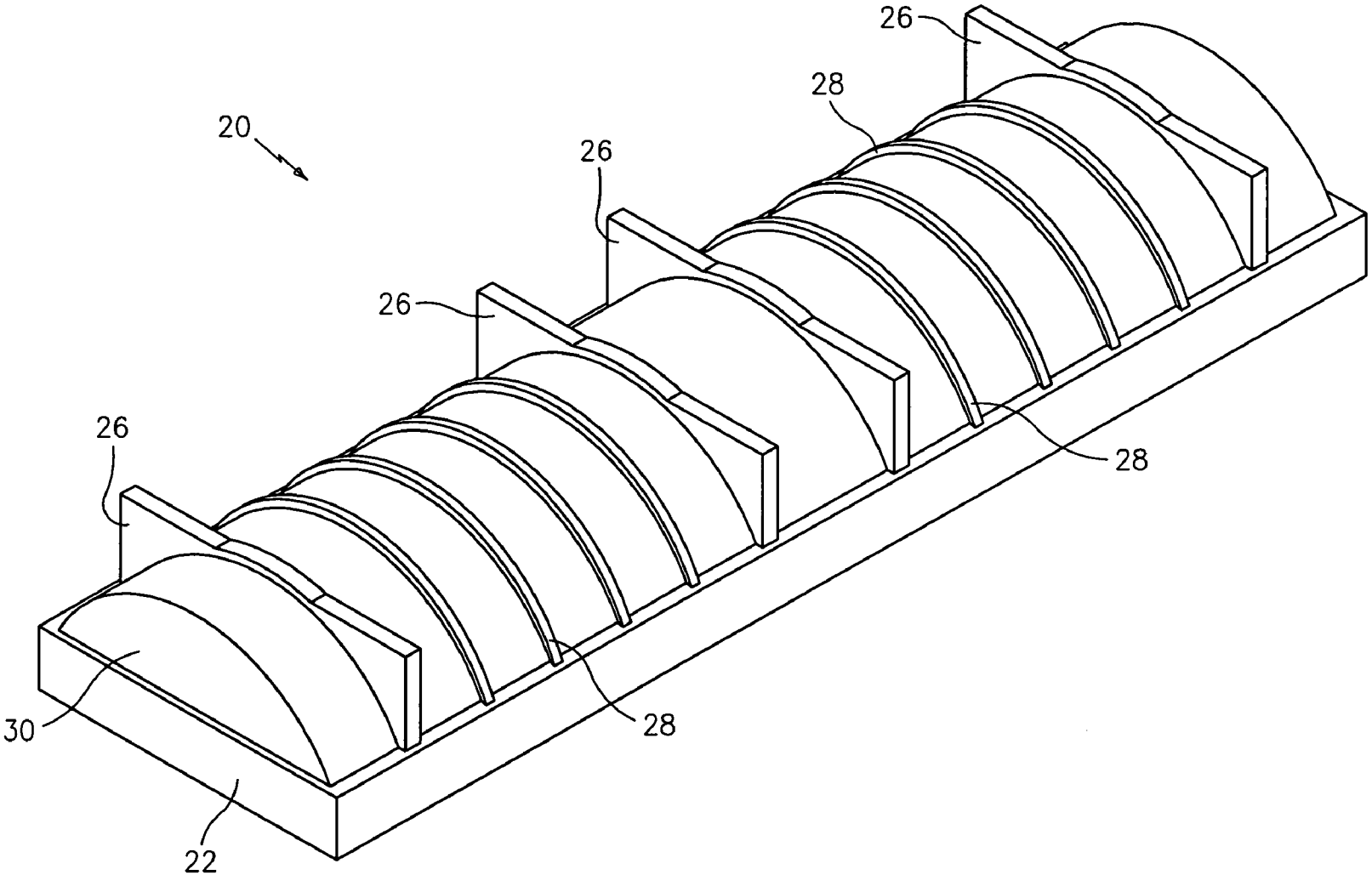
FIG. 5 is a representation of an open-top rail car cover of the present disclosure.
Figure 6:
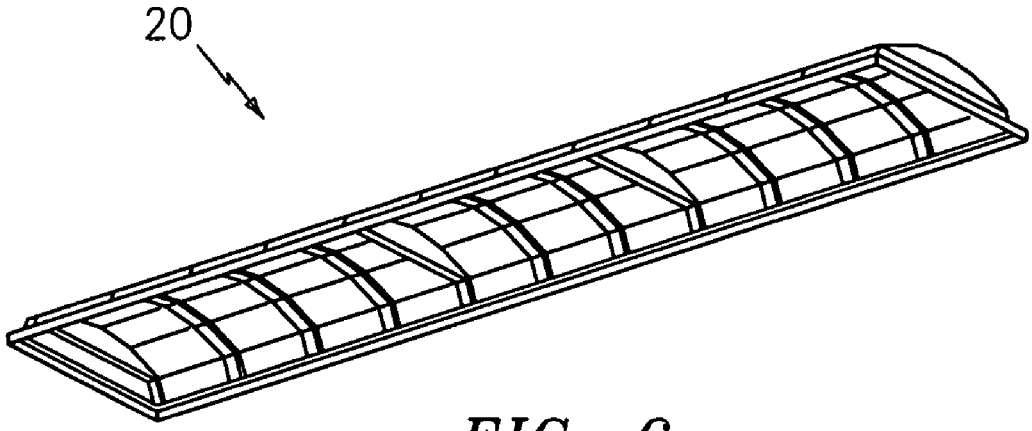
FIG. 6 is a representation of an underside view of the cover of FIG. 5.
Figure 7:
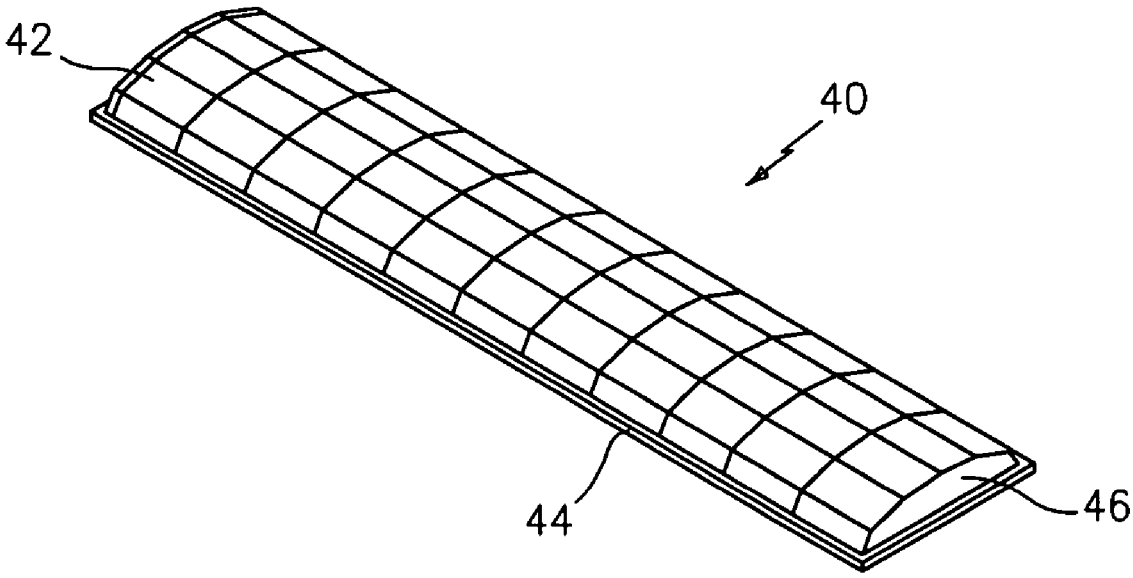
FIG. 7 is a representation of another open-top rail car cover of the present disclosure.

Referring generally now to FIGS. 5-11, the open-top rail car cover 20 and latch mechanism are shown. The cover 20 generally comprises a frame 22 having dimensions sufficient to fit any open-top rail car or freight car known to one of ordinary skill in the art. More specifically, the frame 22 has dimensions sufficient to fit a freight car that complies with the open-top freight car classifications of the AAR and, preferably, the Class G, Class H and Class L open-top freight car classifications. A first material disposed in contact with the frame 22 forms a roof 24. A second material disposed in contact with the frame 22 and roof 24 forms a pair of end walls 30 disposed opposite each other. As illustrated in FIGS. 5 and 6, the roof 24 may have one or more surface features such as ribs 26, corrugations 28, and the like, which provide structural strength. In the alternative, an open-top cover 40 may have a roof 42 free of any surface features disposed in contact with a frame 44 and pair of end walls 46 as illustrated in FIG. 7.

The first and second materials may be substantially the same and may include, but are not limited to, urethanes, polystyrenes, polyesters, epoxies and the like, and combinations comprising at least one of the foregoing materials, as well as at least one reinforcing agent such as, but not limited to, ceramic fibers, fibrous glass, glass cloth, glass fabric, glass fiber, calcium silicate, diatomaceous earth, expanded vermiculite, cellulose fibers, woven fabric, non-woven fabric, compacted powder, compacted fiber, mineral fiber, mineral wool, perlite, refractory materials, wood fibers, poly-para-phenylene terephthalamide fibers and the like, and combinations comprising at least one of the foregoing reinforcing agents, as well as one or more additives such as, but not limited to, abrasion resistant materials, sweat resistant materials, chemical resistant materials, blackbody materials, fire resistant materials, fire retardant materials, intumescent materials, water vapor retardant materials, mold resistant materials, mildew resistant materials, solvent resistant materials, caustic resistant materials, freeze-thaw resistant materials, water resistant materials and the like, and combinations comprising at least one of the foregoing additives. In addition, the resulting cover may include a coating having an aesthetic, utilitarian or other purpose that may be applied to at least a portion of, if not the entirety of, the cover 20. The coating may include, but is not limited to, anti-abrasive, appearance coverings, blackbody coatings, breather coatings, mastic coatings, moisture barrier coatings, weather barrier coatings, combinations comprising at least one of the foregoing coatings, and the like.

Figure 8:
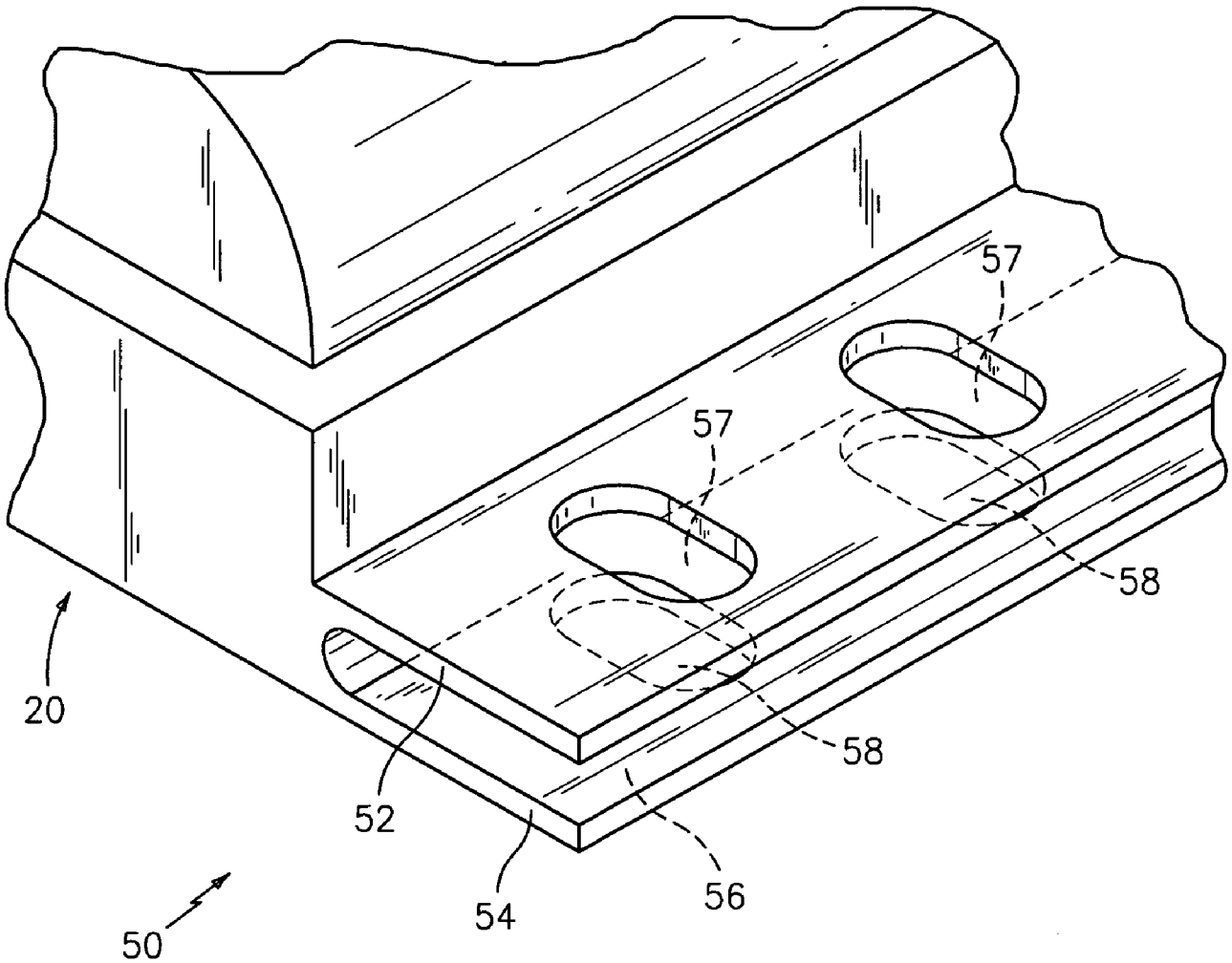
FIG. 8 is a representation of a latch of the open-top rail car covers of the present disclosure.

Referring now to FIGS. 8-11, a latch mechanism 50 for use with the open-top covers and rail cars described herein are shown. Latch mechanism 50 of cover 20 may be disposed along one or more sides 12 of the rail car 10. Referring now to FIG. 8, latch mechanism 50 may comprise a first flange 52 and a second flange 54 that combine to define a means for receiving 56 an engagement member 60 of the rail car 10. Each flange 52, 54 include a plurality of apertures 57, 58, respectively, capable of receiving a means for securing 70. As shown in FIG. 8, the plurality of first apertures 57 and plurality of second apertures 58 may be substantially aligned.

Figure 9:
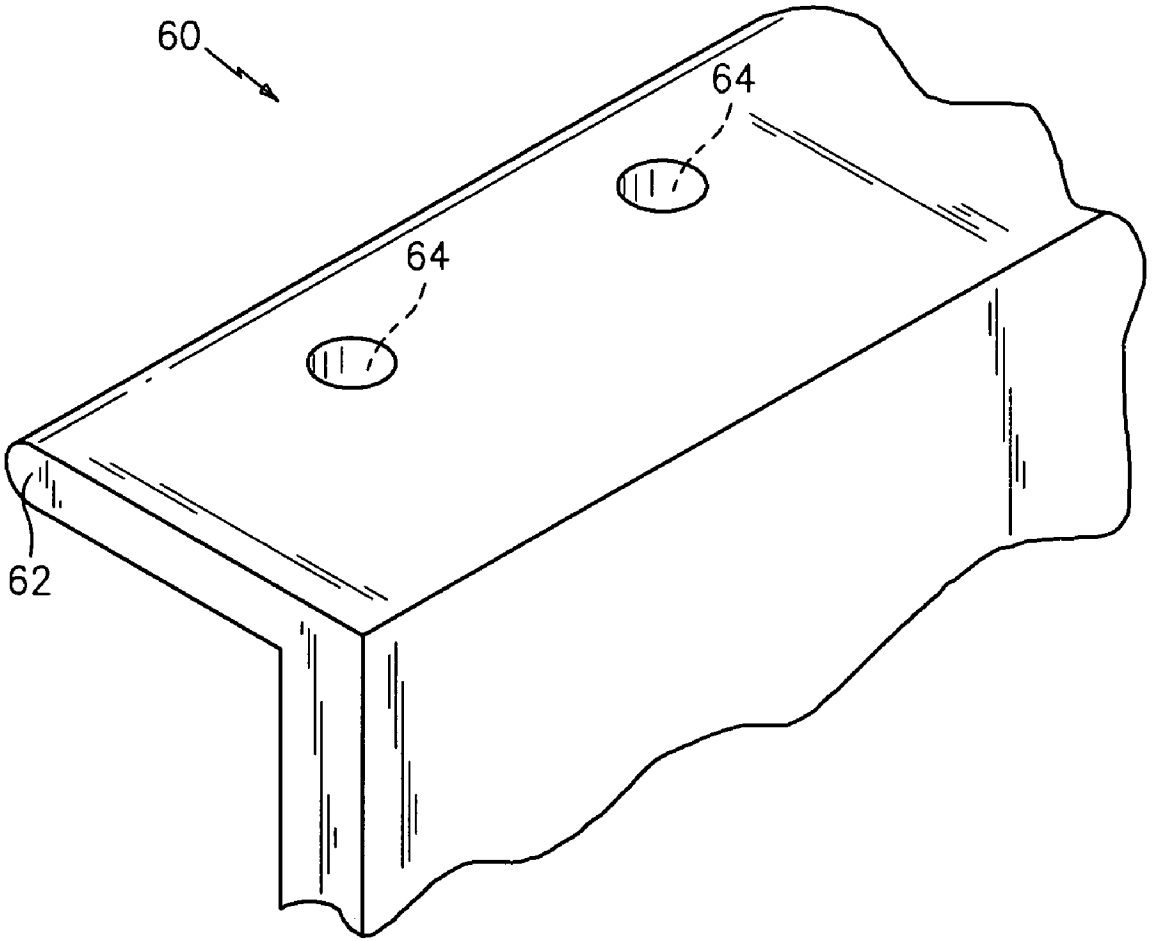
FIG. 9. is a representation of an engagement member of the present disclosure for an open-top rail car.
Figure 11:
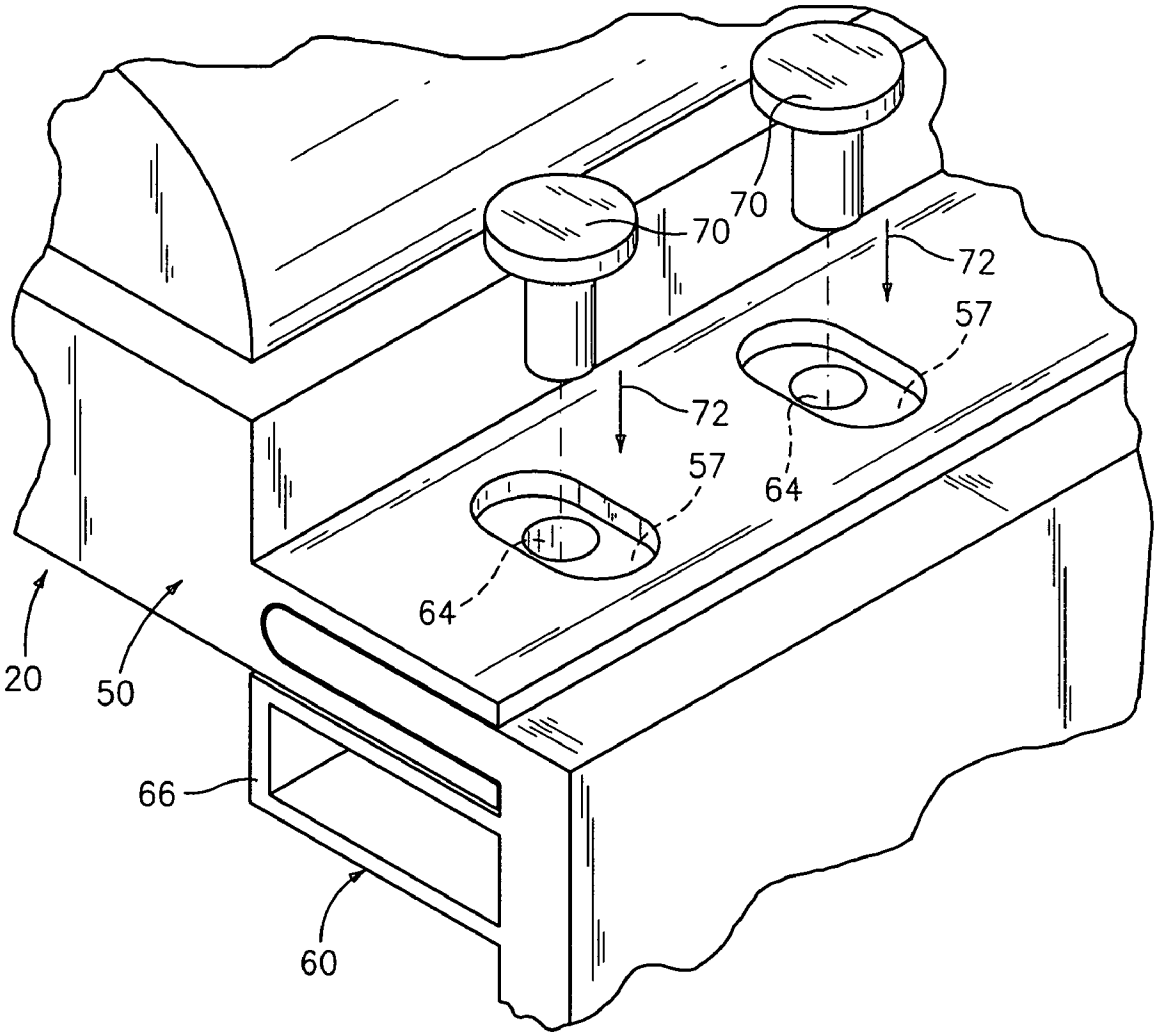
FIG. 11 is a representation of the latch of FIG. 8 secured to another engagement member for an open-top rail car.

Referring now to FIG. 9, the engagement member 60 of the rail car 10 may be disposed along an edge of one or more sides 12. Generally, the engagement member may comprise an L-shaped flange 62 having a plurality of third apertures 64; each aperture 64 capable of receiving a means for securing 70. In the alternative, engagement member 60 may further comprise a support member 66 as shown in FIG. 11. The support member 66 may be a separate piece of hardware mounted to engagement member 60 using any number of methods known to one of ordinary skill in the art, or may be integrally formed with engagement member 60 as illustrated. Whether being integrally formed or a separate piece, support member 66 may include a plurality of third apertures (not shown) substantially the same as the third apertures 64 of the engagement member 60. Support member 66 serves to buttress the L-shaped engagement member 60, provide an additional anchor to the engagement member 60 for the means for securing 70, and strengthen the attachment of the cover 20 to the rail car 10.

Figure 10:
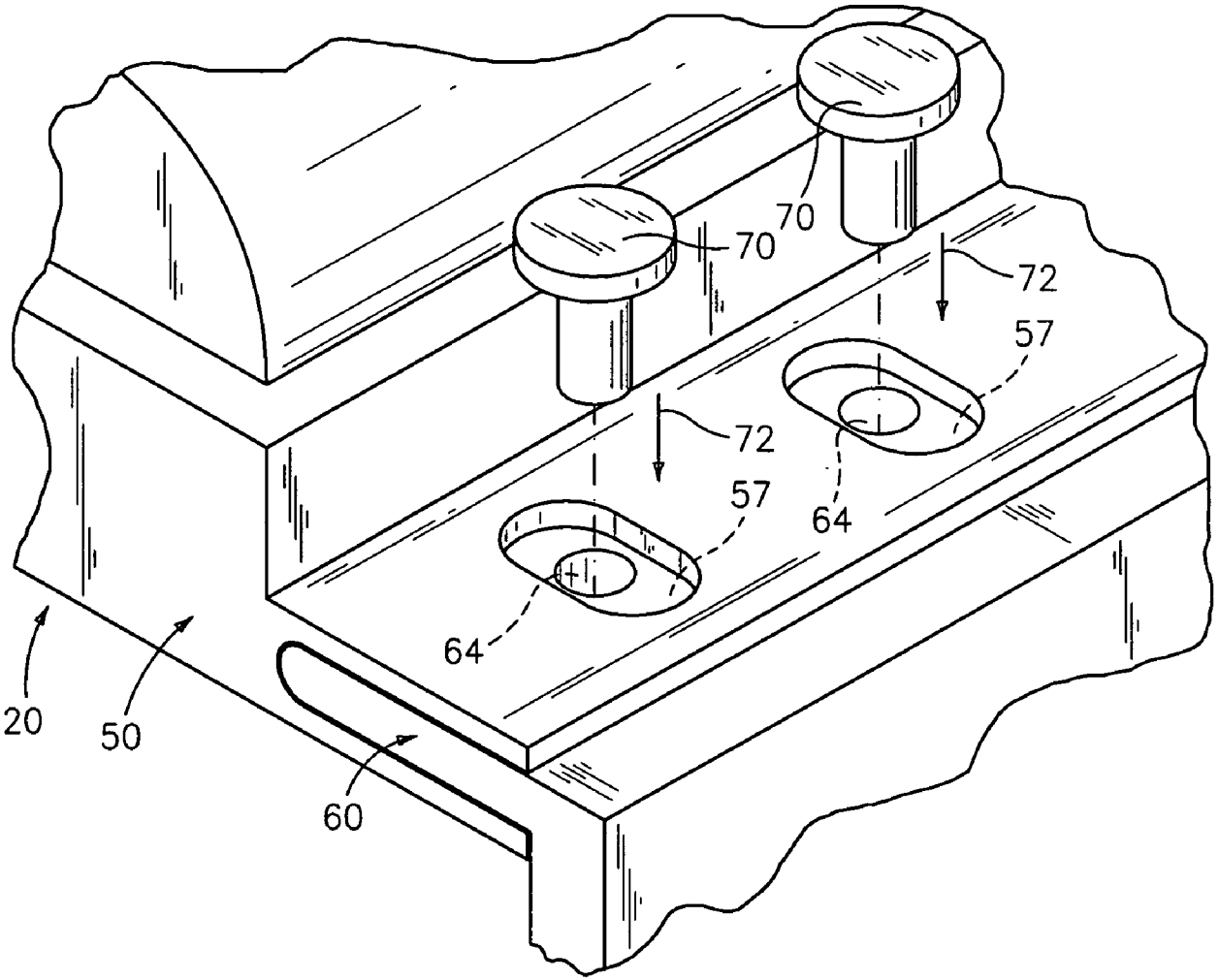
FIG. 10 is a representation of the latch of FIG. 8 secured to the engagement member of FIG. 9.

Referring now to FIGS. 10 and 11, engagement member 60 may insert within the means for receiving 56 of the latch mechanism 50. When inserted, the plurality of third apertures 64 of the engagement member 50 may substantially align with both the plurality of first apertures 57 and plurality of second apertures 58 of the latch mechanism 50 as shown in FIGS. 10 and 11. One or more means for securing may then be inserted in the direction indicated by an arrow 72 through the plurality of first apertures, second apertures and third apertures 57, 58, 64 of the latch mechanism 50, engagement member 60 and support member 66, if included. The means for securing 70 may be any object that can be punched, welded, screwed, inserted, bolted, injected, hammered, combinations comprising at least one of the foregoing methods, and the like, that are known to one of ordinary skill in the art.

Each first and second aperture 57, 58 have dimensions sufficient to permit movement of the first and second flanges 52, 54, and latch mechanism 20, about each means for securing 70. In contrast, each third aperture 64 have dimensions sufficient to ensure a close fit with each means for securing 70. This movement about the means for securing 70 permits the cover 20 to move an amount sufficient to compensate for the forces acting upon the cover 20 as the rail car 10 moves. During transit, the cover 20 is less likely to buckle under and break in response to such forces. As a result, the open-top cover described herein possesses a longer useful service life which translates into reduced transportation costs over a long term period.

It is to be understood that the invention is not limited to the illustrations described and shown herein, which are deemed to be merely illustrative of the best modes of carrying out the invention, and which are susceptible to modification of form, size, arrangement of parts, and details of operation. The invention rather is intended to encompass all such modifications which are within its spirit and scope as defined by the claims.

What is claimed is:

1. An open-top rail car cover, comprising:

a roof connected to a frame having dimensions sufficient to fit a freight car type selected from the group consisting of: a gondola car type, a hopper car type and a special car type, said frame comprising a pair of side walls disposed opposite each other, one of said side walls including a latch, and a pair of end walls disposed opposite each other and connected to said pair of side walls; and wherein said latch comprises a first flange and a second flange that combine to define a means for receiving an engagement member of a rail car, wherein said first flange includes at least one first aperture designed to receive a means for securing, and said second flange includes at least one second aperture designed to receive said means for securing, wherein said engagement member includes at least one third aperture designed to receive said means for securing, and wherein said at least one first aperture, said at least one second aperture and said at least one third aperture are substantially aligned with each other.

2. The open-top rail car cover of claim 1, wherein said at least one first aperture and said at least one second aperture comprise slots.

3. The open-top rail car cover of claim 1, wherein said roof comprises one or more surface features.

4. The open-top rail car cover of claim 1, wherein said means for receiving comprises a channel.

5. The open-top rail car cover of claim 1, wherein said engagement member is designed to be inserted within said means for receiving.

6. The open-top rail car cover of claim 1, wherein said means for securing is disposed through said at least one first aperture, said at least one third aperture and said at least one second aperture.

7. The open-top rail car cover of claim 1, wherein said at least one first aperture and said at least one second aperture have dimensions sufficient to permit movement of said first flange and said second flange about said means for securing.

8. The open-top rail car cover of claim 1, wherein said roof is formed by a material which comprises at least one of the following materials: urethanes, polystyrenes, polyesters, and epoxies and said pair of end walls is formed by a material which comprises at least one of the following materials: urethanes, polystyrenes, polyesters and epoxies.

9. The open-top rail car cover of claim 8, wherein said material forming said roof and said material forming said end walls each further comprise at least one reinforcing agent selected from the group consisting of ceramic fibers, fibrous glass, glass cloth, glass fabric, glass fiber, calcium silicate, diatomaceous earth, expanded vermiculite, cellulose fibers, woven fabric, non-woven fabric, compacted powder, compacted fiber, mineral fiber, mineral wool, perlite, refractory materials, wood fibers, and poly-paraphenylene terephthalamide fibers.

10. The open-top rail car cover of claim 8, wherein said material forming said roof and said material forming said end walls each further comprise at least one additive selected from the group consisting of abrasion resistant materials, sweat resistant materials, chemical resistant materials, blackbody materials, fire resistant materials, fire retardant materials, intumescent materials, water vapor retardant materials, mold resistant materials, mildew resistant materials, solvent resistant materials, caustic resistant materials, freeze-thaw resistant materials, and water resistant materials.

11. The open-top rail car cover of claim 1, further comprising at least one coating disposed upon at least one of the following: said frame, said first material, said second material and said latch, wherein said coating is selected from the group consisting of anti-abrasive coatings, appearance coverings, blackbody coatings, breather coatings, mastic coatings, moisture barrier coatings, and weather barrier coatings.

12. An open-top rail car with cover, comprising:

an open-top freight car comprising a freight car type selected from the group consisting of: a gondola car type, a hopper car type, and a special car type;

wherein said open-top freight car further comprises an engagement member having at least one third aperture designed to receive a means for securing, said engagement member is capable of engaging a car cover disposed about a top portion of said car, wherein said car cover comprises:

a roof connected to a frame comprising:

a pair of side walls disposed opposite each other, and one side wall includes a latch; and a pair of end walls disposed opposite each other and connected to said pair of side walls; and wherein said latch comprises a first flange and a second flange that combine to define a means for receiving said engagement member, wherein said first flange includes at least one first aperture designed to receive a means for securing, said second flange includes at least one second aperture designed to receive said means for securing, and wherein said at least one first aperture, said at least one second aperture and said at least one third aperture are substantially aligned with each other.

13. The open-top rail car with cover of claim 12, wherein said at least one first aperture and said at least one second aperture comprise slots.

14. The open-top rail car with cover of claim 12, wherein said roof comprises one or more surface features.

15. The open-top rail car with cover of claim 12, wherein said means for receiving comprises a channel.

16. The open-top rail car with cover of claim 12, wherein said engagement member is designed to insert within said means for receiving.

17. The open-top rail car with cover of claim 12, wherein said means for securing is disposed through said at least one first aperture, said at least one third aperture and said at least one second aperture.

18. The open-top rail car with cover of claim 12, wherein said at least one first aperture and said at least one second aperture have dimensions sufficient to permit movement of said first flange and said second flange about said means for securing.

19. The open-top rail car cover of claim 12, wherein said roof is formed by a material which comp rises at least one of the following materials: urethanes, polystyrenes, polyesters, and epoxies and said pair of end walls are formed by a material which comprises at least one of the following materials: urethanes, polystyrenes, polyesters and epoxies.

20. The open-top rail car cover of claim 19, wherein said material forming said roof and said material forming said pair of end walls each further comprise at least one reinforcing agent selected from the group consisting of ceramic fibers, fibrous glass, glass cloth, glass fabric, glass fiber, calcium silicate, diatomaceous earth, expanded vermiculite, cellulose fibers, woven fabric, non-woven fabric, compacted powder, compacted fiber, mineral fiber, mineral wool, perlite, refractory materials, wood fibers, and poly-paraphenylene terephthalamide fibers.

21. The open-top rail car cover of claim 19, wherein said material forming said roof and said material forming said pair of end walls each further comprise at least one additive selected from the group consisting of abrasion resistant materials, sweat resistant materials, chemical resistant materials, blackbody materials, fire resistant materials, fire retardant materials, intumescent materials, water vapor retardant materials, mold resistant materials, mildew resistant materials, solvent resistant materials, caustic resistant materials, freeze-thaw resistant materials, and water resistant materials.

22. The open-top rail car cover of claim 12, wherein said car cover further comprises at least one coating disposed thereon, said at least one coating selected from the group consisting of anti-abrasive coatings, appearance coverings, blackbody coatings, breather coatings, mastic coatings, moisture barrier coatings, and weather barrier coatings.

* * * * *